United States Patent [19]

Brassine

[11] 4,327,630

[45] May 4, 1982

[54] HUMIDIFIER

[76] Inventor: Robert L. Brassine, 3421 Glenn-Don, #2, Anchorage, Ak. 99504

[21] Appl. No.: 158,438

[22] Filed: Jun. 11, 1980

[51] Int. Cl.[3] ..... B01F 3/04

[52] U.S. Cl. ..... 98/105; 126/113; 137/391; 137/588; 261/72 R; 261/103; 261/106

[58] Field of Search ..... 98/105, 109; 126/113; 137/391, 431, 587, 588; 261/103, 106, 72 R

[56] References Cited

U.S. PATENT DOCUMENTS

| | | | |
|---|---|---|---|
| 152,744 | 7/1874 | Griffith | 98/105 X |
| 1,498,189 | 6/1924 | Moehlenbrock | 126/113 |
| 2,217,375 | 10/1940 | Miller | 126/113 X |
| 2,366,906 | 1/1945 | Hester | 239/42 |
| 2,765,120 | 10/1956 | Mascolo | 210/223 |
| 3,092,096 | 6/1963 | Nett et al. | 126/113 |
| 3,127,106 | 3/1964 | Giroud | 149/82 |
| 3,265,305 | 8/1966 | Johnson | 237/78 R |
| 3,432,080 | 3/1969 | Venus, Jr. | 137/588 X |
| 3,525,354 | 8/1970 | Parrish | 126/113X |
| 3,860,063 | 1/1975 | Riello | 65/36 |
| 3,929,941 | 12/1975 | Horne | 126/113 X |

FOREIGN PATENT DOCUMENTS 1238173 4/1967 Fed. Rep. of Germany ..... 126/113

*Primary Examiner*—Albert J. Makay
*Assistant Examiner*—Harold Joyce
*Attorney, Agent, or Firm*—William D. Hall; Darle M. Short

[57] ABSTRACT

A humidifier that will operate without being supplied with power from an outside source is provided. The humidifier must be placed directly in the stream of heated air coming from a heat source in order to properly operate. The humidifier is comprised of a housing, a hydrocell, and an evaporative element. The hydrocell and the evaporative element are both located within the housing, the evaporative element being directly below the hydrocell. The hydrocell is heat-responsive, and when it is heated, water will drip from the hydrocell onto the evaporative element. The heated air passing thru the humidifier will first contact the now-moist evaporative element and absorb some of the humidity therefrom. An optional feature of this invention is a valve located within the hydrocell that is connected to a water source and which will regulate the flow of water into the hydrocell without the need of human assistance.

27 Claims, 25 Drawing Figures

HUMIDIFIER

This invention relates to room humidifiers. More particularly, this invention relates to room humidifiers which do not need an external source of power (i.e., electricity) to operate.

BACKGROUND OF THE INVENTION

Most room humidifiers now on the market are electrically powered and must be plugged into a wall socket to operate. These electrically powered humidifiers have electrical motors therein which may emit an unpleasant noise. Also, many prior art humidifiers tend to be cumbersome since they are constructed to stand on the floor and may interfere with normal human activity in the room.

Humidifiers that do not require electricity to operate are known. However, these humidifiers are usually designed to be used with one type of heating system (usually radiators) and are not very versatile. Moreover, these humidifiers involve an evaporative element that is constantly in contact with the water supply. These prior humidifiers generally comprise a container of water with a very absorbent material projecting both below and above the surface of the water, so that the water in the container container will rise by capilliary action along the absorbent material. These devices are usually placed on or next to a heat source. Because the container is usually between the heat source and the absorbent material, these humidifiers are not very effective or efficient.

Thus, it is apparent that there exists a need for a non-electrically powered humidifier which is easily adaptable to be used with many types of heating systems and which is highly efficient.

This invention fulfills this need and many other needs apparent to the skilled artisan in the relevant art once given the following disclosure:

SUMMARY OF THE INVENTION

This invention is a humidifier, which does not require electricity to operate, comprising in its basic embodiments a housing, a hydrocell, and an evaporative element. Air-directing louvers can be attached to the bottom of the housing so that the humidifier is adaptable to all types of heating systems.

The hydrocell and the evaporative element are contained within the housing, the hydrocell being located above the evaporative element in the housing. The hydrocell can be made of a plastic and for optimum performance is filled about two-thirds full with water. When the cap of the hydrocell is properly placed on the hydrocell, the hydrocell is airtight. The hot air from the heat source will be directed through the humidifier and pass around the hydrocell, causing the air in the hydrocell to expand, and forcing water out an opening in the hydrocell. This opening can either be above or below the water level of the hydrocell. If the opening is above the water level, then there is provided a tube which extends below the water level at one end and at the other end directs the water to the evaporative element.

When the hydrocell is cooling, the atmospheric pressure inside the hydrocell will be decreasing. This will draw air into the hydrocell through an opening located in the bottom of the hydrocell. The air can be drawn through this opening without any water dripping out since the hydrocell is airtight and the water level is so shallow.

The humidifiers according to this invention can be employed with some air conditioners now on the market.

Furthermore, the hydrocells according to this invention automatically regulate the amount of moisture available for evaporation depending on the humidity of the ambient air since the hydrocells operate on the differential of the air pressure between the inside of the hydrocell and the ambient air.

This invention has many advantages over the room humidifiers presently known in the art.

One advantage of this invention is that it provides a highly effective room humidifier which does not need electricity to operate.

Another advantage of this invention is that it provides a highly effective room humidifier which is essentially noise-free.

A further advantage of this invention is that it provides a room humidifier which can be easily adapted for use with most types of heating systems and with some air conditioning systems.

Yet another advantage of this invention is that it provides a room humidifier wherein the heated air is directed at the evaporative element without interference from the water container of the humidifier. This design feature enables this device to be highly effective and efficient in its operation.

It is also an advantage of this invention that the evaporative elements of the devices according to this invention are easily replaceable.

A further advantage of some embodiments of this invention is that the humidifier automatically refills whenever the water level in the hydrocell drops below a predetermined level; thus the humidifier will keep operating without human assistance.

Yet another advantage of this invention is that it provides a humidifier that does not need electricity to operate which automatically regulates the amount of moisture it will make available for evaporation based on the moisture content of the ambient air.

Generally speaking, this invention provides a humidifier that does not need any power to operate, comprising a housing, an evaporative element, and a hydrocell, the hydrocell and the evaporative being attached inside the housing with the hydrocell being located above the evaporative element, the hydrocell being airtight and responsive to heat such that when said hydrocell is heated, the increase in pressure inside the hydrocell will force water to drip from the hydrocell upon the evaporative element.

Certain embodiments of this invention will now be described by reference to the accompanying drawings wherein:

IN THE DRAWINGS

Figure 1:
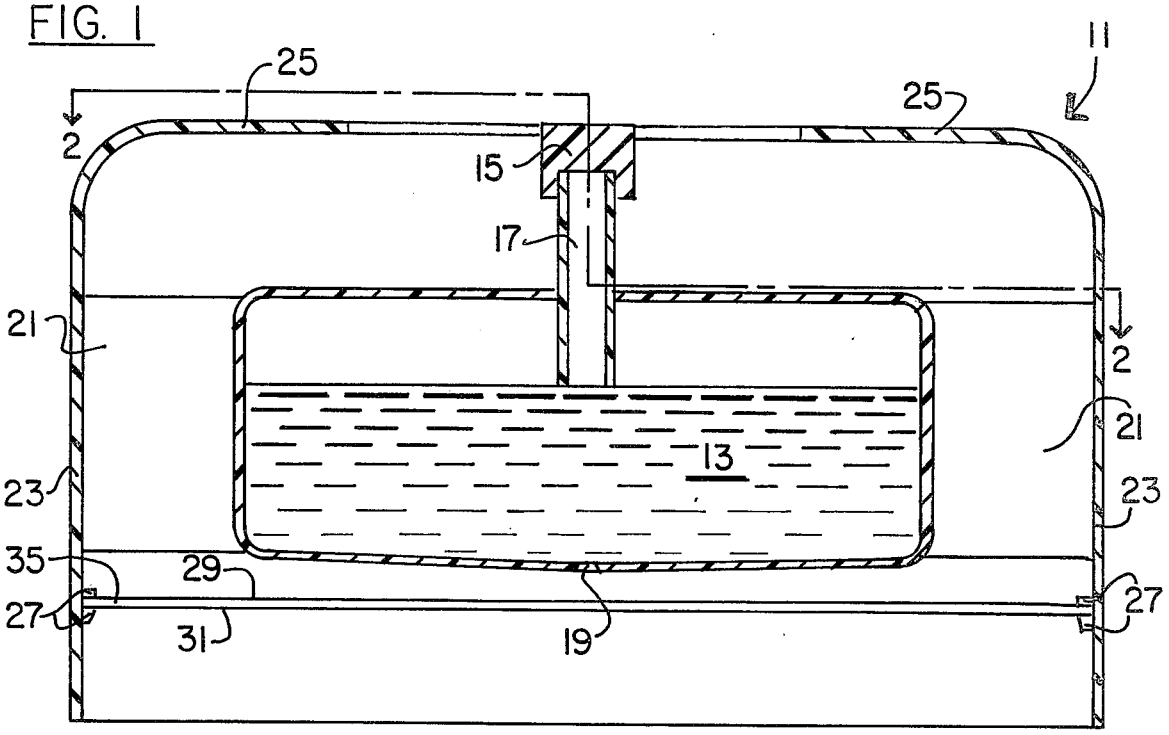
FIG. 1 is a sectionalized side view of one embodiment of this invention.
Figure 2:
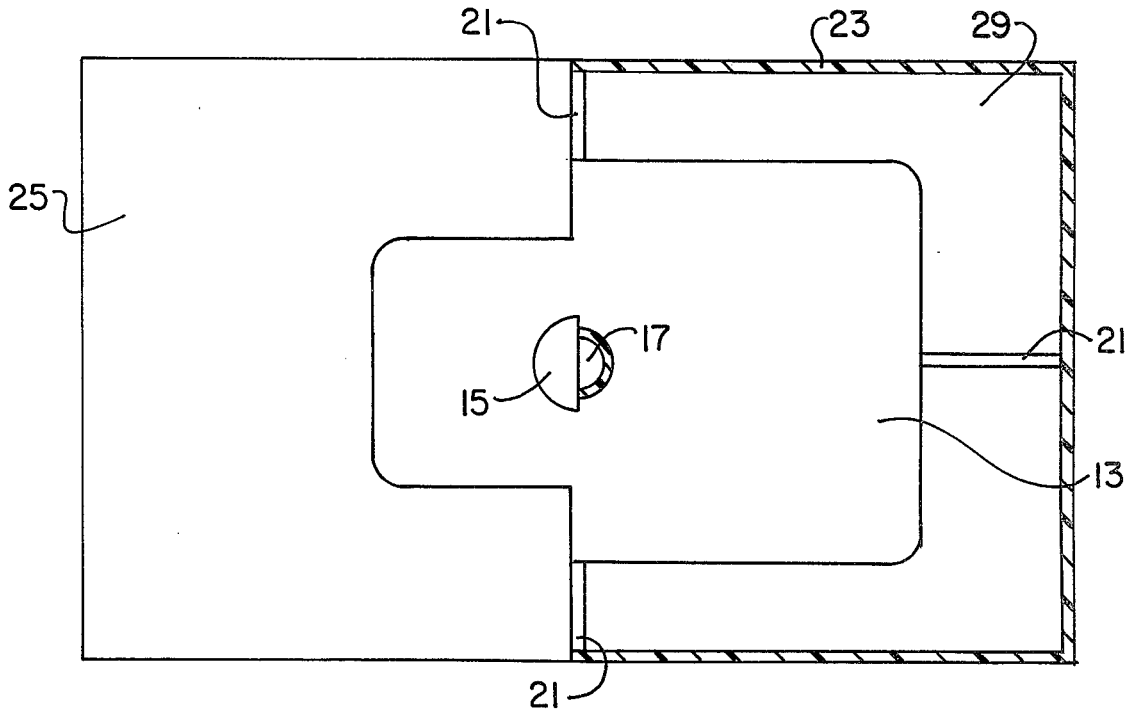
FIG. 2 is a plan view, partially sectionalized along line 2—2 of FIG. 1, of the embodiment of this invention illustrated in FIG. 1.
Figure 3:
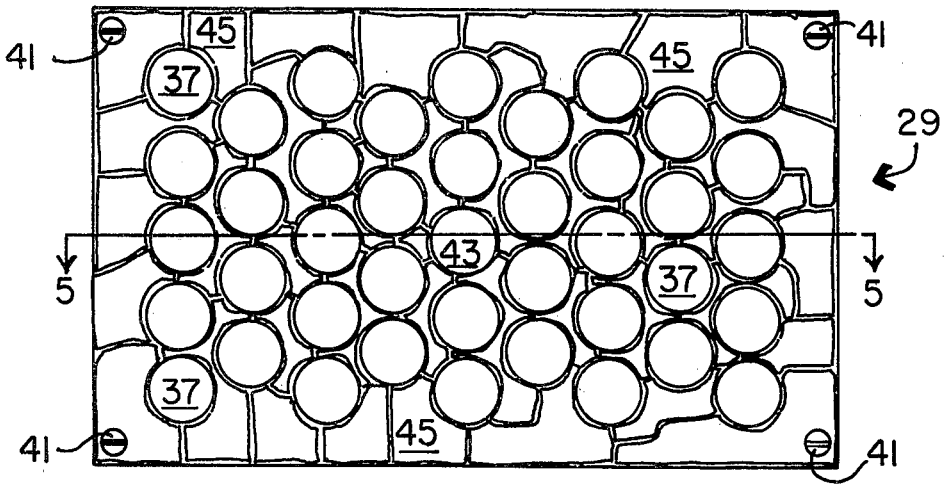
FIG. 3 is a plan view of the top plate of one embodiment of the evaporative element which can be employed in this invention.
Figure 4:
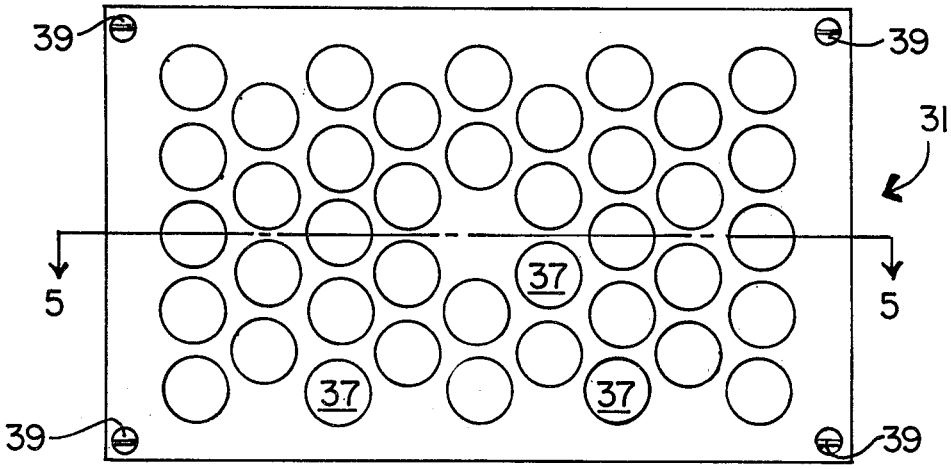
FIG. 4 is a plan view of the bottom plate of the evaporative element illustrated in FIG. 3.
Figure 5:
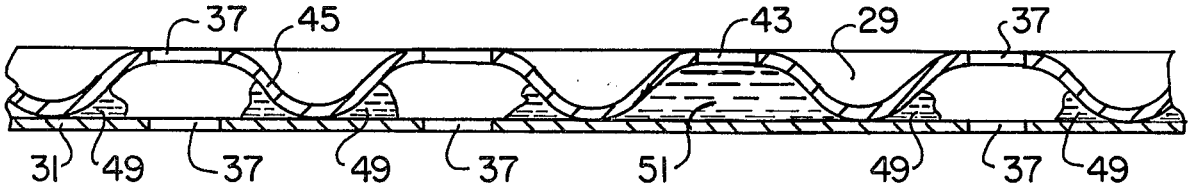

FIG. 5 is a sectionalized side view, taken along lines 5—5 of FIGS. 3 and 4, of the evaporative element embodiment illustrated in FIGS. 3 and 4.

Figure 6:
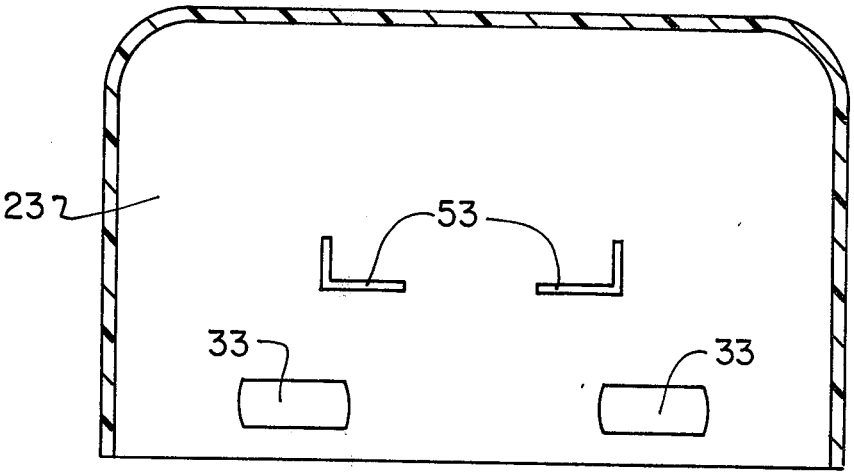
Figure 7:
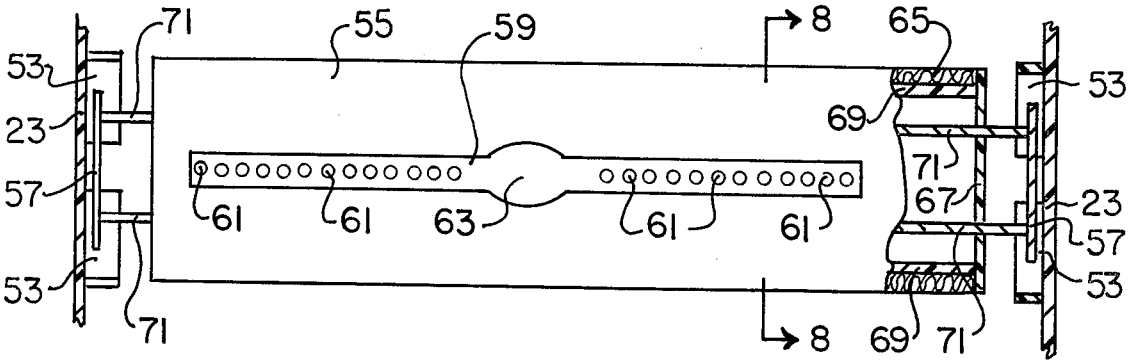
Figure 8:
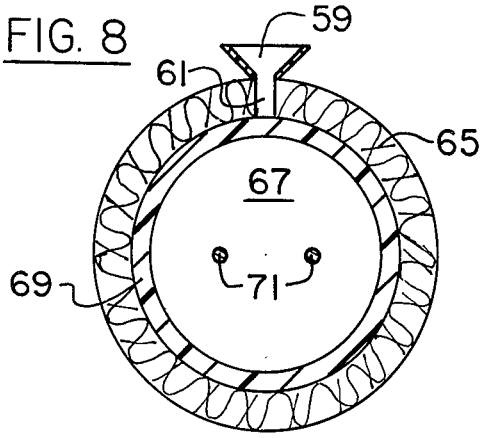

FIG. 6 is a sectionalized side view of the housing of the embodiment of FIGS. 7 and 8 and illustrates the location of the supports for the evaporative element.

FIG. 7 is a plan view, partially sectionalized, of another embodiment of the evaporative element of this invention.

FIG. 8 is a sectionalized view of the evaporative element embodiment illustrated in FIG. 7 taken along line 8—8 of FIG. 7.

Figure 9:
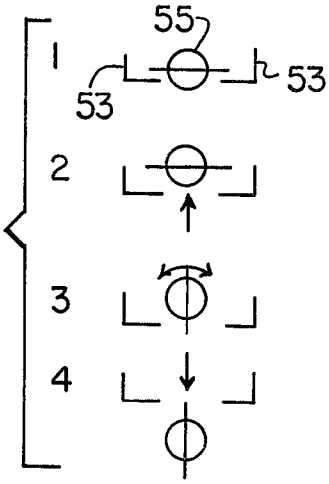

FIG. 9 is a series of schematic views illustrating how the evaporative element embodiment illustrated in FIGS. 7 and 8 can be removed from its supports within the housing.

Figure 10:
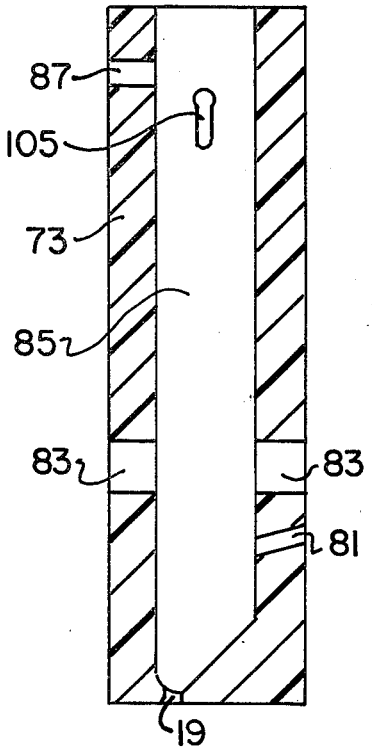

FIG. 10 is a sectionalized side view of a valve assembly body which can be employed in the practice of this invention.

Figure 11:
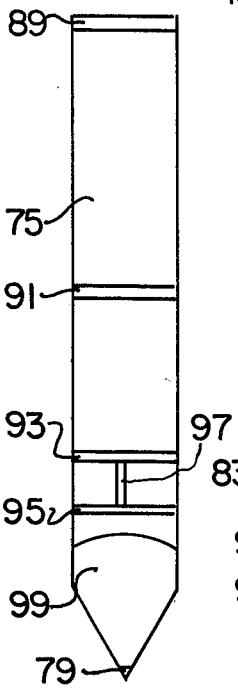

FIG. 11 is a side view of a valve assembly stem which can be employed with the valve assembly body illustrated in FIG. 10.

Figure 12:
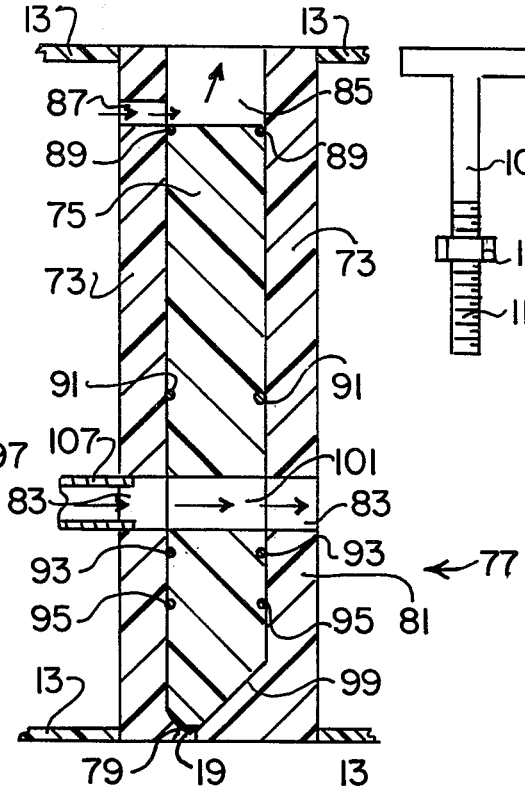

FIG. 12 is a sectionalized side view of a valve assembly that can be employed with this invention to regulate the intake of water into the hydrocell, showing the valve stem in the down position permitting the intake of water.

Figure 13:
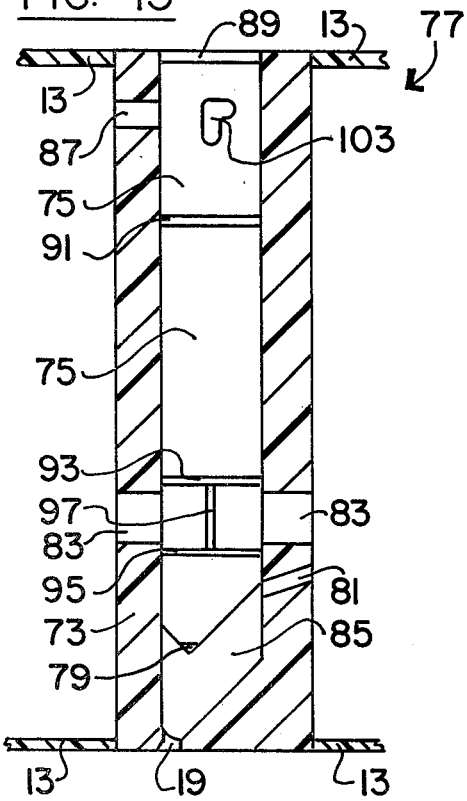

FIG. 13 is a side view, partially sectionalized, of the valve assembly illustrated in FIG. 12, showing the valve assembly in the closed position, thus blocking the flow of water into the hydrocell.

Figure 14:
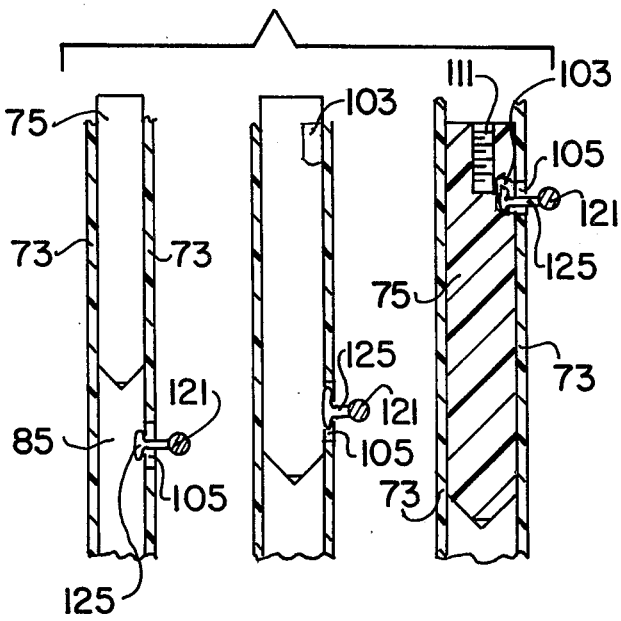

FIG. 14 is a series of three partially sectionalized side views of the valve assembly of FIGS. 10–13, illustrating how the valve stem is inserted in the valve body and attached to the float assembly.

Figure 15:
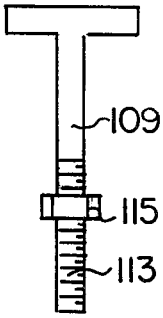

FIG. 15 is a side view of a tool which can be employed to insert and withdraw the valve stem from the valve assembly.

Figure 16:
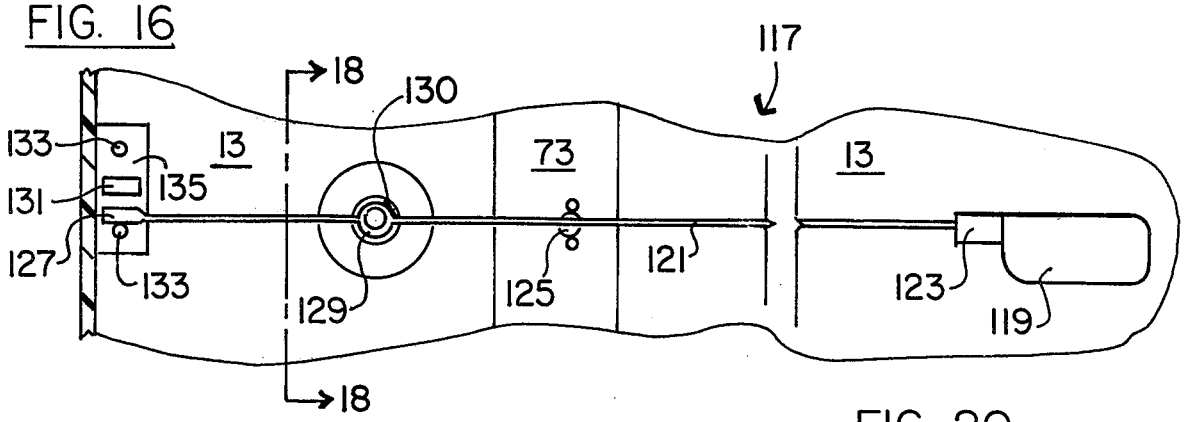

FIG. 16 is a side view of the float and valve assemblies as assembled in the hydrocell.

Figure 17:
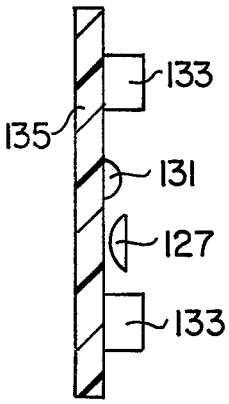

FIG. 17 is a sectionalized side view of the float rod control plate assembly that can be employed with the valve and float assemblies illustrated in FIG. 16.

Figure 18:
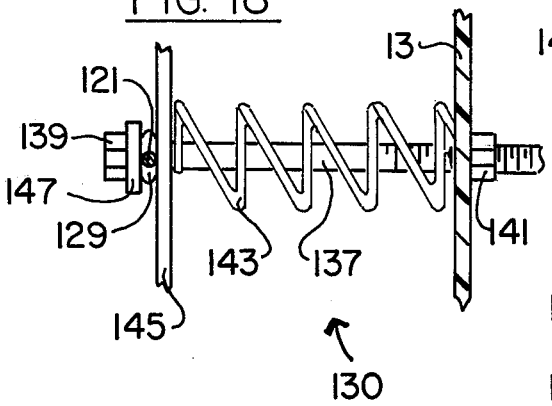

FIG. 18 is a sectionalized side view taken along line 18—18 of FIG. 16 of the float rod pivot assembly that can be employed with the valve and float assemblies illustrated in FIG. 16.

Figure 19:
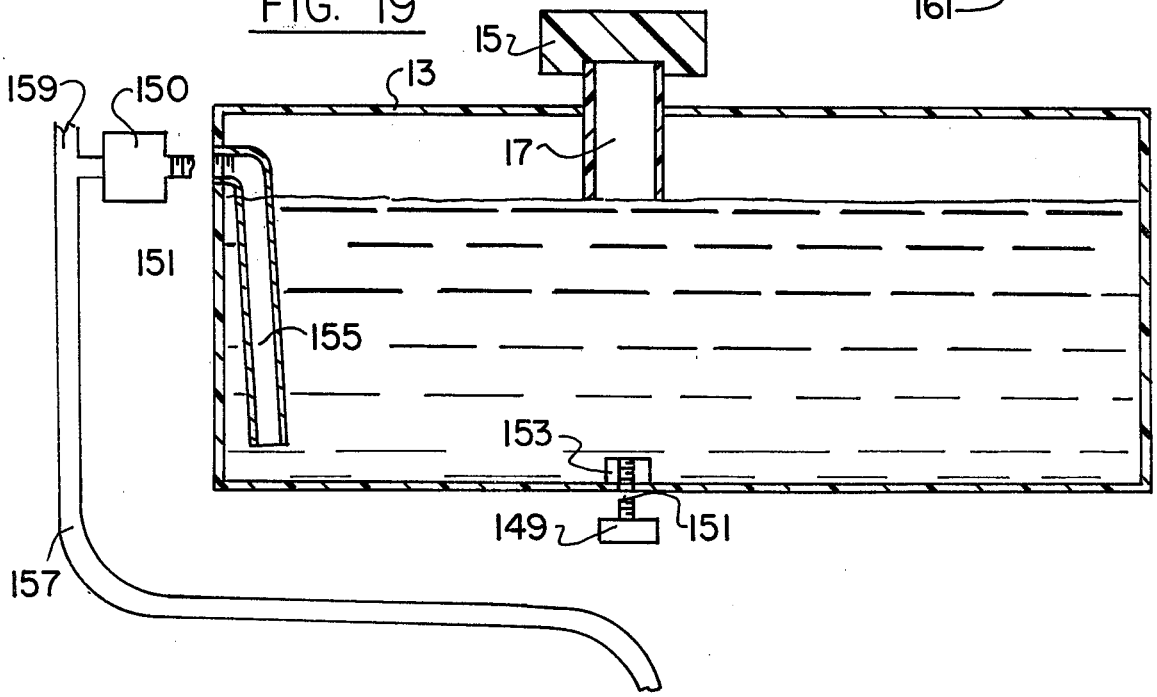

FIG. 19 is a side view, partially sectionalized, of another embodiment of the hydrocell that can be employed with this invention.

Figure 20:
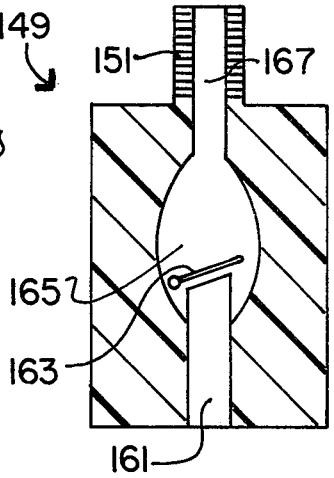

FIG. 20 is a sectionalized side view of a valve assembly which can be employed with the hydrocell embodiment illustrated in FIG. 19.

Figure 21:
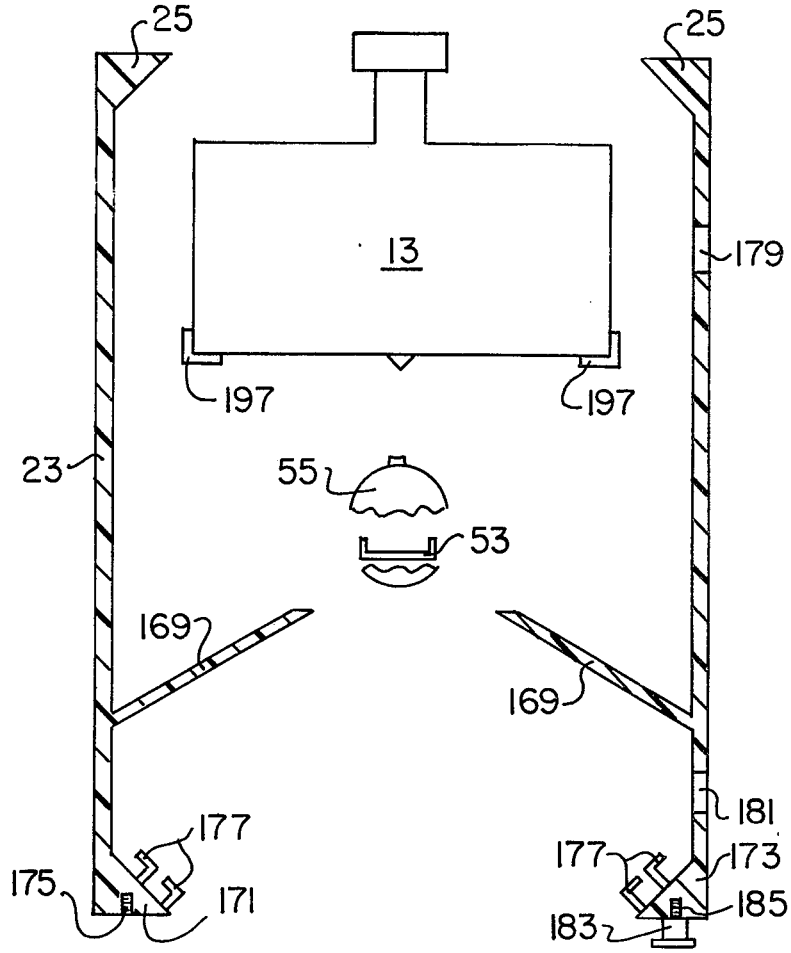

FIG. 21 is a sectionalized front view of another embodiment of this invention.

Figure 22:
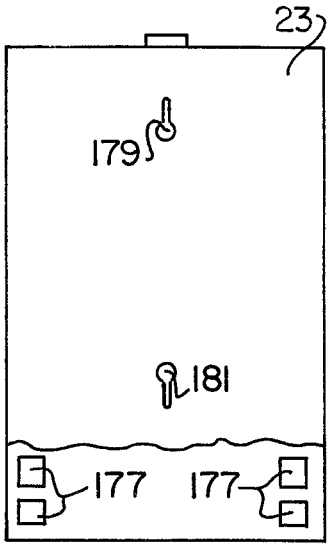

FIG. 22 is a side view with a cutout portion, of the embodiment of this invention illustrated in FIG. 21.

Figure 23:
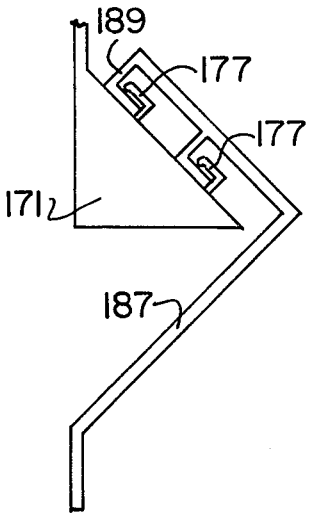

FIG. 23 is a side view illustrating the connection of a louver to the housing of the embodiment illustrated in FIG. 21, the louver being designed to direct air coming up from the bottom of the humidifier past the evaporative element.

Figure 24:
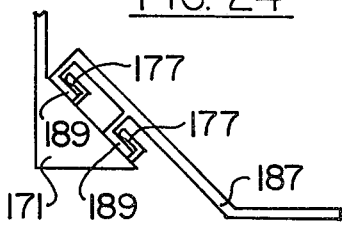

FIG. 24 is a side view of a louver designed to direct air coming from the side of the humidifier past the evaporative element.

Figure 25:
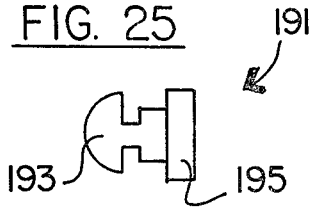

FIG. 25 is a side view of a wall pad that can be employed with the housing illustrated in FIGS. 21 and 22.

DETAILED DESCRIPTION OF THE DRAWINGS

Referring to the accompanying drawings, numerous embodiments of this invention are illustrated.

One embodiment is illustrated in FIGS. 1–5. In this embodiment, humidifier 11 is comprised of hydrocell 13, housing 23, and evaporative element 35. Hydrocell 13 and evaporative element 35 are located within housing 23 with hydrocell 13 being located above evaporative element 35.

Housing 23 can be comprised of plastic. It has louvered top 25 so that the heated air passing thru humidifier 11 is directed around and over the top of hydrocell 13, increasing the efficiency of humidifier 11. Hydrocell 13, which can also be made out of a plastic, is attached to housing 23 by hydrocell supports 21. Hydrocell 13 is designed to be airtight when properly assembled.

Hydrocell 13 has located at the lowest point in the bottom thereof pin hole 19. Pin hole 19 is of a size such that if the atmospheric pressure inside hydrocell 13 remains constant, the water within hydrocell 13 will not drip through pin hole 19. However, when the atmospheric pressure inside hydrocell 13 is increasing, pin hole 19 is of a size such that the increase in pressure will force water through pin hole 19. Furthermore, when the atmospheric pressure within hydrocell 13 is decreasing, pin hole 19 will allow air therethrough so that the atmospheric pressure within hydrocell 13 will reach the same level as the ambient atmospheric pressure.

Optimally, hydrocell 13 should be about two-thirds full of water (or any other suitable liquid) when in operation and be designed so that the water is about four-six inches deep when the hydrocell is two-thirds full. When hydrocell 13 is heated, the thermal expansion of the air within hydrocell 13 causes the water within to begin dripping through pin hole 19 as discussed above.

Hydrocell 13 also has filler neck 17 to facilitate the filling of hydrocell 13 with water. Cap 15 fits on the top of filler neck 17 and when properly in place seals hydrocell 13 virtually airtight so that any air entering hydrocell 13 must come thru pin hole 19.

Evaporative element 35 is snapped into molded ridges 27 of housing 23. Evaporative element 35 in this embodiment is comprised of top plate 29 and bottom plate 31 (see FIGS. 3–5). Top plate 29 and bottom plate 31 are connected by screws 41 which are received by screw holes 39 in bottom plate 31. Top plate 29 and bottom plate 31 can be easily separated for cleaning by removing screws 41.

Bottom plate 31 is a flat plate with vent holes 37 therethrough in the pattern as shown in FIG. 4. Top plate 29 also has vent holes 37 therethrough in the same relative position as in bottom plate 31 so that vent holes 37 extend all the way through evaporative element 35. Furthermore, top plate 29 has water inlet hole 43 in the center thereof directly below pin hole 19 when humidifier 11 is properly assembled. Top plate 29 has indentations 45 therein such that the bottom of indentations 45 interface with bottom plate 31 when top plate 29 and bottom plate 31 are connected as shown in FIG. 5. Indentations 45 are also shown in FIG. 3.

The embodiment of FIGS. 1 to 5 operates as follows: Humidifier 11 is assembled as described above and hung above a heat vent. Hydrocell 13 is filled to the two-thirds level with water (or other suitable liquid) and cap 15 is secured on filler neck 17 to seal the hydrocell 13. When heat rises from the heat vent and passes through housing 23, hydrocell 13 will be heated which will cause water to drop through pin hole 19 as discussed above. The water that drops through pin hole 19 will pass through water inlet hole 43 of top plate 29 and form main pocket of water 51. As main pocket of water 51 fills, the water will spread by capillary action throughout the spaces between top plate 29 and bottom plate 31 since these plates are so closely spaced together. The water will spread throughout evaporative element 35, forming pockets of water 49 throughout. Pockets of water 49 will surround vent holes 37 in bottom plate 31 (see FIG. 5). As the warm air passes up through humidifier 11, some of the air will pass through vent holes 37, contacting and evaporating in part pockets of water 49. This action increases the humidity of the air as its passes thru humidifiers 11.

FIGS. 7 and 8 illustrate other evaporative element embodiment that can be employed in this invention. Evaporative element 55 is similar to a paint roller, having a plastic shell 69, which comprises a hollow cylinder, an outer layer of absorbent material 65, and two end pieces 67. Running the entire length of evaporative element 55, and passing out each end piece 67 are wires 71. Cross supports 57 connect the ends of wires 71 to stabilize the structure of evaporative element 55. Cross supports 57 rest in supports 53 when evaporative element 55 is in place. Embedded in evaporative element 55, and positioned at the top thereof when evaporative element 55 is properly in place, is trough 59. Trough 59 has a main portion 63 which catches the water drops as they fall from pin hole 19 and channels the water towards both ends of trough 59. Trough 59 has spaced drainage holes 61 therein. Drainage holes 61 extend all the way through absorbent material 65 as shown in FIG. 8 so that the water is soaked up along the entire cross-section of absorbent material 65.

The method of removing evaporative element 55 for cleaning, or replacing, is shown in FIG. 9. First evaporative element 55 is lifted off of supports 53, then turned 90°, and pulled out thru supports 53.

FIG. 6 shows a housing which can be employed with evaporative element 55. Supports 53 are affixed to the inside of housing 23. Vent holes 33 are provided so that humidifier 11 will be more quickly cooled after the flow of heated air through humidifier 11 stops (i.e., when the furnace shuts off). This helps prevent evaporative element 55 from getting so saturated that water drips from it.

FIGS. 10–18 illustrate a valve and float assembly which can be used within certain embodiments of the hydrocells of this invention. The valve and float assemblies can be employed with a water supply line, as described below, to regulate the quantity of water in the hydrocell. This enables the humidifiers according to this invention to operate over a long time span without the need for any human attention, except for periodic cleaning or changing of the evaporative element and the seals. Valve assembly 77 has two positions, the down position as shown in FIG. 12, and the up position as illustrated in FIG. 13.

Valve assembly 77 consists of two main members, valve body 73 and valve stem 75. To assemble valve assembly 77, valve stem 75 is placed into chamber 85 of valve body 73 as shown in FIG. 14 and as later described in detail. Valve body 73 can be constructed of plastic and extends from the bottom to the top of hydrocell 13. There is an uncapped opening in hydrocell 13 above valve stem 75. Water passageways 83 are located in the sidewalls of valve body 73 as shown in FIGS. 10 and 12. Also located in the sidewalls of valve body 73 are air vent connector slot 105 and passageway 81. Passageway 81 allows water from hydrocell 13 to enter stem chamber 85 and exit through pin hole 19 and also allows air entering pin hole 19 (during cooling) to pass into hydrocell 13 when valve stem 75 is in the up position. Air vent 87 allows the passage of air from hydrocell 13 into the atmosphere when valve stem 75 is in the down position.

Valve stem 75 is illustrated in FIG. 11. Valve stem 75 has a tapered area 99 which fits in the bottom of stem chamber 85. At the very bottom tip of valve stem 75 is located stem tip 79 which will seal pin hole 19 when valve stem 75 is in the down position as shown in FIG. 12. Valve stem 75 as located thereon O-ring seals 89, 91, 93 and 95, and seals 97. These seals prevent water and air from getting in between valve body 73 and valve stem 75 in stem chamber 85 as desired. Valve stem 75 also has located therein water passageway 101, which is a cylinder that passes completely thru valve stem 75.

As previously stated, FIG. 12 shows valve assembly 77 with valve stem 75 in the down position. This figure also shows water supply line 107 which is attached to either one of water passageways 83. When valve stem 75 is in the down position, stem tip 79 closes pin hole 19 and passageway 81 is closed. Water passageway 101 of valve stem 75 is now in line with water passageways 83 of valve housing 73, allowing water to enter hydrocell 13 thru these passageways. At this same time, air from within hydrocell 13 can escape thru air vent 87.

After hydrocell 13 has been filled to the desired level, the float assembly (described in detail below) will cause valve stem 75 to rise to the up position as shown in FIG. 13. In this position, water passageways 83 are now closed off by valve stem 75 and sealed by O-rings 93 and 95 and seal 97. Air vent 87 is also now blocked off by valve stem 75. However, passageway 81 is now open and pin hole 19 unblocked to permit water and air to flow therethrough.

FIG. 14 illustrates how valve stem 75 can be placed and secured within valve housing 73. As valve stem 75 is slid down into valve body 73 it engages float assembly connector 125 (which passes thru connector slot 105 in valve body 73) and pushes float assembly connector 125 out of stem chamber 85. When valve stem 75 is moved further into valve body 73, connector 125 (which is spring loaded) engages connector slot 103 in valve stem 75, effectively securing valve stem 75, valve body 73, and float assembly rod 121 (to which the other end of connector 125 is attached) together.

A tool which can be used to place and remove valve stem 75 into and from valve body 73 is shown in FIG. 15. Stem tool 109 has threaded end 113 which is designed to engage threaded hole 111 of valve stem 75. After stem tool 109 is screwed into valve stem 75, jam nut 115 can be employed to assist in the placement or removal of valve stem 75.

FIG. 16 presents an overall side view of float assembly 117 which can be employed with the valve assembly described above. Float assembly rod 121 has connected at one end thereof float 119 and weight 123. These members, of course, rest on the water surface and move vertically in response to changes thereto. At the opposite end of float assembly rod 121 is located bevelled end 127. As float 119 oscillates vertically bevelled end 127 also oscillates vertically, since float assembly 117 rotates around pivot assembly 130. Control plate 135 is attached to the wall of hydrocell 13 and regulates the vertical movement of bevelled end 127 as follows. Control plate 135 has located on its face that is in contact with bevelled end 127, stops 133 and bevelled bump 131. Bevelled bump 131 is spaced in between stops 133.

Thus, when the water level changes sufficiently, float 119 will exert a moment force on float assembly rod 121, with respect to the pivot point of float assembly rod 121, which is pivot assembly 130. Bevelled bump 131 will act to resist this moment force until float 119 and weight 123 exert a large enough force on float assembly rod 121 to overcome bevelled bump 131. Stops 133 determine the maximum distance bevelled end 127 can move.

Float assembly rod 121 has connected thereto float assembly connector 125, which has been previously discussed. Float assembly connector 125 performs the function of connecting float assembly 117 with valve assembly 77.

Float assembly rod 121 is also connected to, and pivots around, pivot assembly 130. Pivot assembly 130 is comprised of bolt 137, nut 141, spring 143, eyelet 129 (which is a part of float assembly rod 121), and washers 145 and 147. Eyelet 129 is placed on bolt 137 between washers 145 and 147. The hole in eyelet 129 is large enough so that eyelet 129 can freely rotate with respect to bolt 137. Spring 143 is placed on bolt 137 between washer 145 and the threaded end of bolt 137. Bolt 137 is then passed through the wall of hydrocell 13, and nut 141 is secured on the threaded end thereof. In this design, eyelet 129 and float assembly rod 121 can move laterally along bolt 137; however, spring 143 will exert a force to push eyelet 129 and washer 147 back to the position shown in FIG. 18.

Another embodiment of hydrocell 13 is illustrated in FIG. 19. In this embodiment, discharge pipe 155 passes through a wall of hydrocell 13 and extends down towards the bottom of hydrocell 13 below the normal surface of the water within hydrocell 13. Also, this embodiment has receiving block 153 at the bottom of hydrocell 13 instead of a pin hole. Check valves 149 and 150, which are illustrated in detail in FIG. 20, are employed in this embodiment. Check valve 149 is connected to receiving block 153, controlling the air intake to hydrocell 13, and check valve 150 controls flow through discharge pipe 155.

As shown in FIG. 20, check valve 149 comprises threaded end 151, inlet passageway 161, flapper 163, chamber 165, and outlet passageway 167. Check valve 150 is exactly the same except that the positions of inlet passageway 161, flapper 163, and outlet passageway 167 are reversed. Extending out of outlet passageway 167 of check valve 150 is discharge tube 157. The other end of discharge tube 157 is located directly over the center of the particular evaporative element being employed.

This embodiment of hydrocell 13 operates as follows. When the heated air passes through humidifier 11, it will heat hydrocell 13 causing the atmospheric pressure of the air within hydrocell 13 to increase, driving water up discharge pipe 155 and into check valve 150. This water will enter inlet passageway 161, open flapper 163 and continue out outlet passageway 167 of check valve 150 into discharge tube 157. When the heating system shuts off, the following occurs. First, the atmospheric pressure will begin to drop. This will cause flapper 163 of check valve 150 to close and flapper 163 of check valve 149 to lift open. Air will then enter hydrocell 13 through check valve 149 until the atmospheric pressure inside hydrocell 13 is roughly equal to the atmospheric pressure outside hydrocell 13.

Another feature of this embodiment is that another type of liquid can be mixed with the water from the hydrocell before the water reaches the evaporative element. This is achieved by having supplemental tube 159 intersect discharge tube 157 between check valve 150 and the end of discharge tube 157 that is over the center of the evaporative element. The other end of supplemental tube 157 can be connected to a container of the desired liquid.

FIGS. 21–24 illustrate another embodiment of this invention. In this embodiment, hydrocell 13 rests on hydrocell supports 197. Hydrocell supports 197 are L-shaped members attached to opposite walls of housing 23. Housing 23 again has louvered tops 25; however, in this embodiment, the hole at the top of housing 23 is large enough to remove hydrocell 13 through. Thus, hydrocell 13 can be easily removed for refilling. This embodiment is designed such that it can be either hung from a wall or placed on a flat surface.

Housing 23 has directing louvers 169 therein to direct the heated air directly on evaporative element 55. Housing 23 of this embodiment also has bottom louvers 171 and 173. Supplemental louvers 187 can be attached (as described below) to bottom louvers 171 and 173 to obtain even better operating efficiency.

Holes 179 and 181 are provided in the wall of housing 23 which will face the static member in the room on which the device may be hung. Hole 179 is designed to fit over a head of a nail, screw, etc., that has been placed in the static structure. Hole 181 is designed to receive pad 191 (as shown in FIG. 25). Head 193 of pad 191 is inserted into hole 181 and moved downward therein, locking it in place. Rubber portion 195 will then rest against the static structure.

Bottom louvers 171 and 173 have clips 177 molded thereto. Supplemental louvers 187, shown in FIGS. 23 and 24, have complementary clips 189 that will attach to clips 177 to affix supplemental louvers 187 to bottom louvers 171 and 173. The supplemental louver 187 illustrated in FIG. 23 is designed to direct air coming from an upward-directing heating source (i.e., a floor register) into the humidifier. The supplemental louver 187 illustrated in FIG. 24 is designed to direct air from a wall register thru the humidifier.

If it is desired to set housing 23 directly on a heat register, rubber pads 183 can be attached by screwing them into holes 175 and 185 as shown in FIG. 21.

Once given the above disclosure, many other improvements, modifications, and features will become apparent to the artisan skilled in the art. Such other improvements modifications, and features are, therefore, considered to be within the scope of this invention as defined by the following claims:

I claim:

1. A humidifier arranged to operate in conjunction with a temperature changing device comprising:

an evaporative element, a heat responsive hydrocell having a liquid outlet from which liquid is emitted, and being adapted to receive a liquid as well as to be exposed to temperature changes created by said device, said evaporative element being located in a position to receive said emitted liquid, means for emitting liquid thru the liquid outlet when the air pressure within the hydrocell is greater than the pressure of the ambient air and for receiving air when the ambient air pressure is greater than the air pressure within the hydrocell, and said liquid outlet is a pinhole located in the bottom of the hydrocell.

2. A humidifier according to claim 1 wherein said evaporative element is located underneath said pinhole.

3. A humidifier according to claim 2 wherein said air enters the hydrocell through said pinhole.

4. A humidifier according to claim 1 further comprising:

a first and a second check valve, said first check valve being attached to said liquid outlet such that it only permits liquid to exit through the outlet, said second check valve being attached to an opening in said hydrocell and having one end open to the ambient air, wherein said second check valve only permits the ambient air to enter said hydrocell.

5. A humidifier according to claim 3 including a housing and wherein said hydrocell and said evaporative element are located within said housing.

6. A humidifier according to claim 5 wherein said hydrocell has an opening in the top for filling said hydrocell with said liquid, and wherein said humidifier further comprises a cap to close said opening and making the hydrocell airtight.

7. A humidifier according to claim 6 wherein the housing has at least one louver that directs air around the hydrocell.

8. A humidifier according to claim 7 wherein said evaporative element is comprised of a first and a second horizontal plate, said plates having portions spaced horizontally and having complementary holes therethrough for the heated air to pass through, said plates receiving said liquid and being spaced close enough together such that capillary action of the liquid will cause the liquid to spread throughout the space between the plates.

9. A humidifier according to claim 8 wherein one of said plates has spaced indentations therein to facilitate the capillary action of the liquid.

10. A humidifier according to claim 9 wherein the top plate of the two plates has a liquid receiving hole that receives the liquid emitted from said hydrocell, and wherein said bottom plate does not have the liquid receiving hole therein.

11. A humidifier according to claim 10 wherein none of said indentations overlap said vent holes, such that pockets of water are formed around said vent holes.

12. A humidifier according to claim 11 wherein said first and said second plates are connected together and wherein the depth of the indentations determines the spacing between the two plates.

13. A humidifier according to claim 12 wherein said housing has two spaced molded ridges therein to receive said evaporative element, and wherein said evaporative element is snapped in the space between said molded rings.

14. A humidifier according to claim 3 wherein said evaporative element is a member having an outer layer of absorbent material.

15. A humidifier according to claim 14 wherein said member is a plastic cylinder having two circular end pieces at the ends thereof.

16. A humidifier according to claim 15 wherein said evaporative element further comprises a trough in the top thereof to collect the liquid emitted from the hydrocell.

17. A humidifier according to claim 16 wherein said absorbent material and said trough have complementary holes therein, said holes spaced the length of said trough.

18. A humidifier according to claim 17 wherein said end pieces have wires running therethrough, said wires extending beyond said end pieces a set length, and wherein said housing has evaporative element supports therein, said wires resting on said supports when said evaporative element is properly in place.

19. A humidifier according to claim 18 wherein said evaporative element supports are L-shaped members spaced apart such that the evaporative element can be easily removed from the housing between said evaporative element supports.

20. A humidifier according to claim 3 wherein said hydrocell has a valve assembly therein, said valve assembly being connected to a liquid supply line, said valve assembly regulating the intake of liquid into the hydrocell.

21. A humidifier according to claim 20 wherein said valve assembly is connected to a float such that the position of said float determines the position of said valve assembly.

22. A humidifier according to claim 21 wherein said valve assembly is comprised of a valve stem and a valve body, said valve stem moving vertically within said valve body to determine the positions of the valve.

23. A humidifier according to claim 22 wherein when said valve stem is in a first position, liquid is permitted into said hydrocell, air is allowed to escape from said hydrocell, and said outlet is closed by said valve stem; and when said valve stem is in a second position, liquid is not permitted into the hydrocell, air is not allowed to escape from the hydrocell, but liquid is allowed to escape thru said outlet.

24. A humidifier according to claim 23 wherein said outlet is a very small hole located in the bottom of said hydrocell, and wherein said valve stem has a rubber tip on the bottom thereof, said rubber tip being received in part by said hole in said hydrocell when said valve stem is in said first position.

25. A humidifier according to claim 24 wherein said valve housing has a first and a second liquid passageway, said valve stem having a third liquid passageway, said liquid supply line being connected to said first liquid passageway, said first, second, and third liquid passageways being substantially in line when said valve stem is in said first position.

26. A humidifier according to claim 21 wherein said float is connected to said valve assembly by a rod, and wherein said rod pivots about a point.

27. A humidifier according to claim 5, further comprising attachable louvers which can be attached to said housing to direct air from said heat source thru said humidifier.

* * * * *